United States Patent [19]

Housman

[11] Patent Number: 4,531,595

[45] Date of Patent: Jul. 30, 1985

[54] WEAR RESISTANT COMPOSITE INSERT AND BORING TOOL WITH INSERT

[76] Inventor: Robert J. Housman, 37 Bearpaw, Irvine, Calif. 92714

[21] Appl. No.: 383,131

[22] Filed: May 28, 1982

Related U.S. Application Data

[60] Continuation of Ser. No. 233,065, Feb. 10, 1981, abandoned, which is a division of Ser. No. 1,900, Jan. 8, 1979, Pat. No. 4,274,840.

[51] Int. Cl.[3] ..... E21B 10/46

[52] U.S. Cl. ..... 175/329; 51/309; 175/410

[58] Field of Search ..... 175/329, 410, 374; 51/307, 309

[56] References Cited

U.S. PATENT DOCUMENTS

| | | | |
|---|---|---|---|
| 3,372,010 | 3/1962 | Parsons | 51/307 |
| 3,389,761 | 6/1968 | Ott | 175/374 |
| 3,594,141 | 7/1971 | Houston et al. | 51/309 |
| 3,850,053 | 11/1974 | Bovenkark | 51/309 |
| 4,140,189 | 2/1979 | Garner | 175/329 |
| 4,171,973 | 10/1979 | Hara et al. | 51/307 |
| 4,411,672 | 10/1983 | Ishizuka | 51/309 |
| 4,440,573 | 4/1984 | Ishizuka | 51/309 |

OTHER PUBLICATIONS

"Properties of Experimental WC-Base Composition", Chapter XI, pp. 188-191.

*Primary Examiner*—William F. Pate, III
*Attorney, Agent, or Firm*—Christie, Parker & Hale

[57] ABSTRACT

A wear insert for earth boring tools, such as drill bits, has diamonds imbedded in a sintered matrix of tungsten-carbide and Invar. The matrix prior to sintering has a particle size of from about 0.5 to about 10 microns. Invar represents from about 3% to about 20% by weight of the matrix. The diamonds are arrayed in a desired pattern in a matrix preform; compression of the resultant preform at pressures of from about 10 to about 20 tons per square inch consolidates preform. The consolidated preform is sintered at a temperature just below the melting point of Invar in a neutral atmosphere of nitrogen and hydrogen formed of dissociated ammonia. Nitrogen results in the wetting of the diamonds. Hydrogen presents a reducing atmosphere.

12 Claims, 2 Drawing Figures

WEAR RESISTANT COMPOSITE INSERT AND BORING TOOL WITH INSERT

This is a continuation of application Ser. No. 233,065, filed Feb. 10, 1981 now abandoned, which was a division of application Ser. No. 001,900, filed Jan. 8, 1979, now U.S. Pat. No. 4,274,840.

BACKGROUN OF THE INVENTION

The present invention relates to the art of earth boring tools, and, more in particular, to wear inserts particularly adapted for such tools and a method for making the inserts.

Earth boring tools take many forms. An example suitable for illustration here is a rock bit. Rock bits have rotary cutters that rotate on and break up earth formation material. Shirttails shield portions of these cutters from cylindrical bore hole walls and formation cuttings. Surfaces of the shirttails and cutters quite often are subjected to harsh, abrasive environments that tend to rapidly wear the surfaces.

In the formation of a bore hole the diameter of the hole must be held to within very close tolerances. Two reasons for this are to avoid pinching of drill bits and the necessity to ream out bore holes that have been bored under diameter.

The portion of the rock bit that determines a bore hole diameter is called the gage row. The gage row is on the rotary cutters. The gage row is subject to the very abrasive environment. Consequently without protection the gage row tends to wear down to an unacceptable diameter in an unacceptable period of time. Hardened wear resistance inserts in the gage row have been used to maintain gage tolerance over longer periods of time.

Another example of wear that can quickly degrade a tool in use is in the shirttail. The wear of the shirttail from highly abrasive environments results in the necessity of shirttail or bit renewal. Hardened inserts are sometimes used on shirttails to prolong their life. Diamonds in a cement binder have been used as inserts.

Diamonds are only used where compressive stress is not too high and are therefore not usually used where the weight of a drill string would have to be borne by them. U.S. Pat. No. 1,939,991 to Krusell describes a diamond cutting tool utilizing inserts formed of diamonds held in a medium such as tungsten-carbide mixed with a flux or binder of iron, cobalt, or nickel. The purpose for using tungsten-carbide in the binder for diamonds is to prevent the medium from wearing too rapidly and to lose its grip on the diamonds. In the Krusell patent, the flux and tungsten-carbide powder are subjected to pressure such as 30 tons to the square inch, to consolidate them. The resultant consolidated block is drilled to provide recepticles for the diamonds. The diamonds and tungsten-carbide are then packed into the holes with a pressure of much less than three tons per square inch. The tungsten-carbide is said to be sintered to provide a coherent, high-strength binder for the diamonds. Because of the extremely high melting point of tungsten-carbide, it is believed that the flux or binder was sintered and the tungsten-carbide cemented. Sintering is in a neutral atmosphere of hydrogen, nitrogen argon, or the like.

The techniques described in the Krusell patent can result in a weakness in the grip that the carbide has on the diamonds. This weakness is manifested by a physical separation between individual diamond particles and the carbide matrix. Other problems include possible solution of the diamond in the carbide and possible graphitization of the diamonds.

It has long been recognized that tungsten-carbide as a matrix for diamonds has the advantage that the carbide itself is wear resistant and offers prolonged matrix life. The flux or binder of choice has been cobalt because iron based or nickel based alloys "attack" tungsten-carbide by the formation of an eta phase carbide. Eta phase carbides are brittle. See U.S. Pat. No. 3,757,878 to Wilder and Bridwell. The solution proposed by Wilder and Bridwell encapsulates carbide particles in a sheath of a metal that does not attack the carbide. After encapsulation, the desired binder is used.

In a technical paper entitled "Iron-Nickel Bonded Tungsten Carbide" by David Moskowitz (EM 71-911, Society of Manufacturing Engineers, 1971), the problem of eta phase carbide formation in tungsten-carbide and iron or nickel systems is explained. Moskowitz states that the problem can be eliminated by providing an excess of carbon over the stoichiometric requirements of tungsten-carbide. Moskowitz reports success with iron-nickel alloy binder for tungsten-carbide with an excess of carbon. He reports improved hardness and strength for 75 WC/25 (Fe-Ni) compositions, especially with the percentage of nickel in the binder of less than about 30 percent. The particle size of the tungsten-carbide of the Moskowitz study was one micron. Specimens were pressed and then sintered in a vacuum. Moskowitz does not address the problem of diamond looseness in the matrix.

Another technique casts the carbide about the diamonds in a mold. This technique destroys the mold each time. It is an expensive technique. Invar is a well-known iron-nickel alloy noted for its very low coefficient of expansion at temperature below about 300° C. Though Invar is used in this invention, its notorious low coefficient of expansion plays no role in the results achieved by the invention. The alloy is of iron and nickel and contains about 63% iron, 36% nickel, with minor amounts usually of manganese, silicon and carbon, amounting to less than 1% in all. Invar has been used in the past as a binder for diamonds to make a cemented diamond. Nickel itself is a known wetter of diamond.

SUMMARY OF THE INVENTION

The present invention provides an improved insert, earth boring tool, and a method for making the insert.

In general the invention contemplates the use of tungsten-carbide powder and diamonds in a sintered matrix of Invar with sintering taking place in an atmosphere of nitrogen and hydrogen. It is thought that the Invar effectively wets the diamond in a nitrogen atmosphere, but does not react with it. The low coefficient of expansion of Invar has nothing to do with this invention.

In greater particular, the present invention contemplates diamonds in a consolidated bed of powdered tungsten-carbide all bound together by sintered Invar. The individual particles of the powdered tungsten-carbide range in size of from about 0.5 to 10 microns. The Invar preferably has the same particle size and is present in a range of from about 3% to about 20% by weight of the mixture of Invar and tungsten-carbide. Preferably the Invar is present at from about 6% to about 16%. Diamonds are placed on a bed of tungsten-carbide powder and Invar in a desired pattern. The diamonds, Invar and tungsten-carbide are then consolidated by a pressure of between about 10 to about 20 tons per square inch. The consolidated insert preform is sintered at about 1400° C. at about one atmosphere pressure, and in the nitrogen and hydrogen atmosphere. This temperature is about 25° C. below the solidus temperature of Invar. The atmosphere may be provided by dissociated ammonia.

The resulting tungsten-carbide, Invar-diamond insert may then be used in an earth boring tool.

It is thought that the nitrogen of the atmosphere results in the wetting of the diamonds by the Invar. The hydrogen prevents oxidization of the carbide. It is also thought that the small particle size of the tungsten-carbide promotes wetting of it by the Invar.

These and other features, aspects and advantages of the present invention will become more apparent from the following description, appended claims and drawings.

DESCRIPTION OF THE PREFERRED EMBODIMENTS

Figure 1:
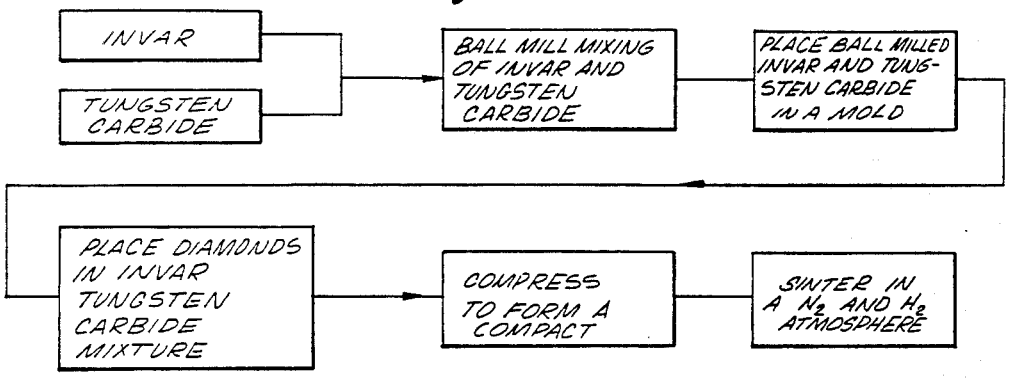
FIG. 1 is a flow chart illustrative of the process of the present invention.
Figure 2:
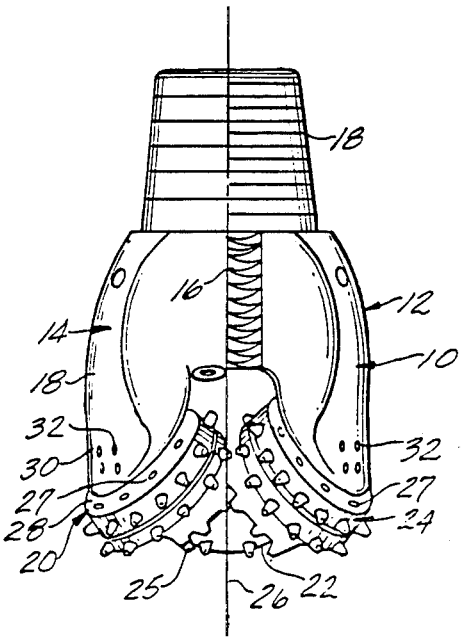
FIG. 2 is a view of a typical rock bit equipped with the inserts of the present invention.

Hardened wear inserts are used in earth boring tools of many sized and describtion. FIG. 2 illustrates an earth boring tool in the form of a rock bit 10 that has the hardened wear inserts of the present invention. In the Figure, the earth boring tool includes three segments spaced apart at 120° C. and welded together at abutting faying surfaces. Two of these segments are shown at 12 and 14, and the weld is shown at 16 . Threads 18 couple the drill bit to the balance of a drill string at the bottom of the drill string. There are three rotary cone cutters 20, 22, and 24. Each rotary cutter rotationally mounts a journal of an associated segment. Thus, cutter 20 mounts on segment 18, and cutter 24 mounts on segment 12. Inserts 25 on each of the rotary cutters scrape and crush rock at the bottom of the drill hole as the rock bit rotates about its axis 26 and the rotary cutters rotate on their journal mounts to the segments.

The diameter of a bore hole must be kept to within close limits. This tolerance is required to avoid bit pinching and corrective bore reaming, among other reasons. If the portion of the bit responsible for the bore diameter wears too rapidly, then the gage diameter quickly gets out of tolerance. For this reason inserts have been used at the gage row of the rotary cutters to reduce the rate of wear. Such inserts placed in the rotary cutters in accordance with the present invention are indicated by reference numeral 27 for all of the cutters. In addition, and in some applications, the protective portion of the segments backing each of the rotary cutters, known as a shirttail and indicated by reference character 30 for segment 18, can be studded with inserts to protect the shirttails from excessive wear. These inserts are shown by reference numeral 32. The insert of the present invention is formed of a mixture of Invar, tungsten-carbide powder, and diamonds at the wear surface of the insert. The Invar acts as a binder Tungsten-carbide itself has good wear characteristics and keeps the bed for the diamonds from wearing away too rapidly and the diamonds dropping out of the insert as a consequence. The Invar wets the diamonds at Invar's sintering temperature in an atmosphere of nitrogen. The wetting markedly improves the strength of the diamond bed. Inserts 25 that bear large compressive loads because of the weight of the drill string above them can be made from Invar and tungsten-carbide powders without the diamonds. The diamonds cannot sustain the compressive loads at the bottom of the bore hole. The Invar-tungsten-carbide inserts are made in the same manner as the Invar-tungsten-carbide diamond inserts.

In general the first step of making the inserts of the present invention is ball mill mixing of Invar powder with tungsten carbide powder to form a mixture of the two. The mixture is placed in a mold. Diamonds are arrayed on a surface of the mixture in the pattern desired for the wear surface of the insert. The surface of the mold cavity conforms to shape and dimensions of the insert. The mixture and diamonds are compressed to consolidate the mixture, the Invar is then sintered in a nitrogen and hydrogen atmosphere to form a coherent object of the Invar, tungsten-carbide and diamonds. The Invar acts as a matrix for the tungsten-carbide and the diamonds. A bond exists between all three consitiuents.

Preferably the Invar is present in the mixture of Invar and tungsten-carbide in an amount by weight of from about 6% to 16%. But from about 3% to about 20% by weight of Invar in the mixture would be satisfactory. Tungsten-carbide is in powder form and has a size preferably, of from about 0.5 to 10 microns. The Invar may be of like particle size. Preferably, the pressure of compression is from about ten to about twenty tons per square inch, with about sixteen tons per square inch being preferred. Compression with the diamonds in place avoids difficulties in getting the binder in intimate contact with the diamonds.

Sintering takes place at about 1425° C., slightly lower than the melting temperature of Invar. Sintering takes place in a furnace in an atmosphere of nitrogen and hydrogen preferably formed by dissociated ammonia. As such, the atmosphere is of nitrogen and hydrogen at a molar ratio of three parts hydrogen to one part nitrogen.

With the present invention, it has been found that diamonds do not tend to separate or become loose from the balance of the insert material because of the intimate bond between the Invar and the diamonds. A coherent object results. Furthermore, it has been found that diamonds do not dissolve in the balance of the material. A good void-free bed for the diamond is provided. The invention enables the use of tungsten-carbide in the matrix and that means a long lasting insert. The Invar as a binder gives good impact, strength, and hardness characteristics.

As is known, Invar is an alloy of nickel and iron, consisting of about 36% nickel, no more than about 1% of other constituents, and the balance iron.

The present invention has been described with reference to a certain preferred embodiment. The spirit and scope of the appended claims should not, however, necessarily be limited to the foregoing description.

What is claimed is:

1. An improved insert for use in earth boring tools and the like comprising a mixture of consolidated tungsten-carbide and Invar with diamonds at the wear surface, the Invar being sintered and the diamonds being bonded to the mixture.

2. The insert claimed in claim 1 wherein the Invar is present in the mixture at from about 3 to about 20 percent by weight.

3. The insert claimed in claim 2 wherein the Invar is present in the mixture at from about 6 to about 16 percent by weight.

4. The insert claimed in claim 3 wherein the tungsten-carbide is in powder form of from about 0.5 to about 10 microns in size.

5. An improvement in earth boring tools of the type having rotary cutters defining a gage diameter of a hole being bored, the cutters being mounted for rotation on a base, the improvement comprising wear inserts at the gage row of the cutters comprising a mixture of consolidated tungsten-carbide and sintered Invar as a bed and diamonds at the wear surface of the insert in the bed, the diamonds being bonded to the tungsten-carbide sintered Invar.

6. The improvement claimed in claim 5 wherein the Invar is present in the mixture at from about 3 to about 20 percent by weight.

7. The improvement claimed in claim 6 wherein the Invar is present in the mixture at from about 6 to about 16 percent by weight.

8. The improvement claimed in claim 7 wherein the tungsten-carbide is in powder form of from about 0.5 to about 10 micron particle size.

9. An improvement in an earth boring tool of the type having rotary cutters and a shirttail backing each cutter at about the gage diameter of the tool, the improvement comprising wear inserts in the shirttails, each insert comprised of a mixture of consolidated tungsten-carbide and sintered Invar as a bed and diamonds in the bed at the wear surface of the insert, the diamonds being bonded to the tungsten-carbide and sintered Invar.

10. The improvement claimed in claim 9 wherein the Invar is present in the mixture at from about 3 to about 20 percent by weight.

11. The improvement claimed in claim 10 wherein the Invar is present in the mixture at from about 6 to about 16 percent by weight.

12. The improvement claimed in claim 11 wherein the tungsten-carbide is in powder form of from about 0.5 to about 10 micron particle size.

* * * * *